US009091506B2

(12) United States Patent
Strahl

(10) Patent No.: US 9,091,506 B2
(45) Date of Patent: Jul. 28, 2015

(54) FLOAT SUPPORT MEMBER FOR ROCKET LAUNCHER

(71) Applicant: Amphenol Corporation, Wallingford, CT (US)

(72) Inventor: Erik Strahl, Unadilla, NY (US)

(73) Assignee: Amphenol Corporation, Wallingford, CT (US)

( * ) Notice: Subject to any disclaimer, the term of this patent is extended or adjusted under 35 U.S.C. 154(b) by 286 days.

(21) Appl. No.: 13/779,250

(22) Filed: Feb. 27, 2013

(65) Prior Publication Data

US 2014/0238223 A1 Aug. 28, 2014

(51) Int. Cl.
*F41F 3/055* (2006.01)
*F41F 3/052* (2006.01)

(52) U.S. Cl.
CPC ..... *F41F 3/055* (2013.01); *F41F 3/052* (2013.01)

(58) Field of Classification Search
CPC ..... F41F 3/048; F41F 3/052; F41F 3/055; F41F 3/073; F41F 3/04; F41F 1/00; F41F 3/00; F42B 15/00; F42B 4/20; F42B 15/36; F42B 3/26; F42B 4/22; F41A 27/24; F42C 19/083
USPC ..... 403/321, 324, 325; 89/1.808, 1.816, 89/1.819, 1.53, 1.8–1.82; 248/342, 584, 248/589, 591, 610
See application file for complete search history.

(56) References Cited

U.S. PATENT DOCUMENTS 2,526,048 A * 10/1950 Russell ..... 68/23.1
2,826,120 A * 3/1958 Lang et al. ..... 89/1.803
3,536,288 A * 10/1970 Rosenbaum ..... 248/591
3,758,158 A * 9/1973 Radke et al. ..... 297/468
4,184,731 A * 1/1980 Betzmeir ..... 439/154
4,291,931 A * 9/1981 Stupay ..... 439/155
4,350,074 A 9/1982 Rouget et al.
4,455,916 A * 6/1984 Whittaker ..... 89/1.812
H405 H 1/1988 Covey
5,168,119 A * 12/1992 Sands ..... 89/1.816
5,983,771 A * 11/1999 Lehr ..... 89/6.5
6,499,526 B1 * 12/2002 St. Amand et al. ..... 156/581
6,679,455 B2 * 1/2004 Chatenet ..... 244/171.2
6,971,300 B2 12/2005 Kunstmann
7,070,434 B2 * 7/2006 Paul et al. ..... 439/271
2012/0055322 A1 3/2012 Angeloff et al.

FOREIGN PATENT DOCUMENTS

EP 148435 6/1988

* cited by examiner

*Primary Examiner* — Troy Chambers
*Assistant Examiner* — Bridget Cochran
(74) *Attorney, Agent, or Firm* — Blank Rome LLP

(57) ABSTRACT

A float support member that comprises a base for mounting to an object, primary linkages rotatably coupled by a primary pin defining a primary movable pin point that moves both in a lateral direction and a transverse direction, and secondary linkages rotatably coupled to said primary linkages, respectively, by first and second secondary pins, respectively. The first and second secondary pins define first and second secondary movable pin points, respectively, that each move both in a lateral direction and a transverse direction. The first and second secondary linkages being rotatably coupled to the base by first and second stationary pins, respectively, defining first and second stationary pin points, respectively. The position of the primary movable pin point in both the lateral and transverse directions depends on the position of both of the first and second secondary moveable pin points in both the lateral and transverse directions and vice versa.

26 Claims, 8 Drawing Sheets

FLOAT SUPPORT MEMBER FOR ROCKET LAUNCHER

FIELD OF THE INVENTION

The present application relates to a float support member that provides float to an object received in the housing. More specifically, the present invention relates to a float support member mountable to a rocket to provide float to the rocket within a launch tube housing while maintaining the electrical connection between the rocket and the launcher.

BACKGROUND OF THE INVENTION

Typical small diameter rockets launched from tubular launchers require a rocket diameter significantly smaller than the tube diameter. In addition, it is often necessary to provide communication between the rocket and launcher prior to launch by means of a separable connection system. The connector components of the connection system often disengaged due to movement of the rocket within the launch tube. Also, any parts associated with the connector system usually increase the profile of the rocket making it difficult to install in the launcher.

Therefore, a need exists for a float mechanism that can maintain the connection system between the rocket and the launcher independent of the radial position of the rocket. In addition, there is a need for a float mechanism for a rocket that is low-profile to both allow installation in an associate launcher and improve the aerodynamics of the rocket once launched.

SUMMARY OF THE INVENTION

Accordingly, the present invention provides a float support member that comprises a base for mounting to an object and first and second primary linkages that are rotatably coupled by a primary pin. The primary pin defines a primary movable pin point that moves both in a lateral direction and a transverse direction transverse to the lateral direction. First and second secondary linkages are rotatably coupled to the first and second primary linkages, respectively, by first and second secondary pins, respectively. The first and second secondary pins define first and second secondary movable pin points, respectively, that each move both in a lateral direction and a transverse direction transverse to the lateral direction. The first and second secondary linkages are rotatably coupled to the base by first and second stationary pins, respectively, that define first and second stationary pin points, respectively. The position of the primary movable pin point in both the lateral and transverse directions depends on the position of both of the first and second secondary moveable pin points in both the lateral and transverse directions and vice versa.

The present invention may also provide a float support member that comprises a base configured for mounting to an object receivable in a housing, first and second primary linkages rotatably coupled by a primary pin, the primary pin is supported by the housing, and the primary pin defines a primary movable pin point that moves both in a lateral direction and a transverse direction transverse to said lateral direction. First and second secondary linkages are rotatably coupled to said first and second primary linkages, respectively, by first and second secondary pins, respectively. The first and second secondary pins define first and second secondary movable pin points, respectively, that each move both in a lateral direction and a transverse direction transverse to the lateral direction. The first and second secondary linkages are rotatably coupled to the base by first and second stationary pins, respectively, that define first and second stationary pin points, respectively. The position of the primary movable pin point in both the lateral and transverse directions depends on the position of both of the first and second secondary moveable pin points in both the lateral and transverse directions and vice versa, thereby providing two degrees of freedom between the base and the housing.

The present invention may further provide a float support member for a rocket launcher, that comprises a base mounted to a rocket that is received in a launch tube housing. First and second primary linkages are rotatably coupled by a primary pin. The primary pin is coupled to a frame supported by the launch tube housing and the primary pin defines a primary movable pin point that moves both in a lateral direction and a transverse direction transverse to the lateral direction. First and second secondary linkages are rotatably coupled to the first and second primary linkages, respectively, by first and second secondary pins, respectively. The first and second secondary pins define first and second secondary movable pin points, respectively, that each move both in a lateral direction and a transverse direction transverse to the lateral direction. The first and second secondary linkages are rotatably coupled to the base by first and second stationary pins, respectively, defining first and second stationary pin points, respectively. Each of the first and second secondary linkages including a spring member. The spring members biasing the first and second secondary movable pin points, respectively, outwardly away from one another. The first and second stationary pins extending through each of the spring members, respectively. The position of the rocket with respect to the launch tube housing is determined by the position of the primary movable pin point in both the lateral and transverse directions which depends on the position of both of the first and second secondary moveable pin points in both the lateral and transverse directions and vice versa, thereby providing two degrees of freedom between the rocket and the launch tube housing.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Referring to the Figures, the present invention provides a float support member 100 preferably used with a rocket launcher that provides the rocket 10 with two degrees of freedom (e.g. X and Y axes) in a launch tube housing 20 of the rocket launcher that receives the rocket, thereby allowing the rocket to float freely at all tolerance extremes. The float support member 100 has a low-profile to facilitate installation of the rocket in the launch tube housing 20 and to improve the aerodynamics of the rocket when launched.

Figure 1:
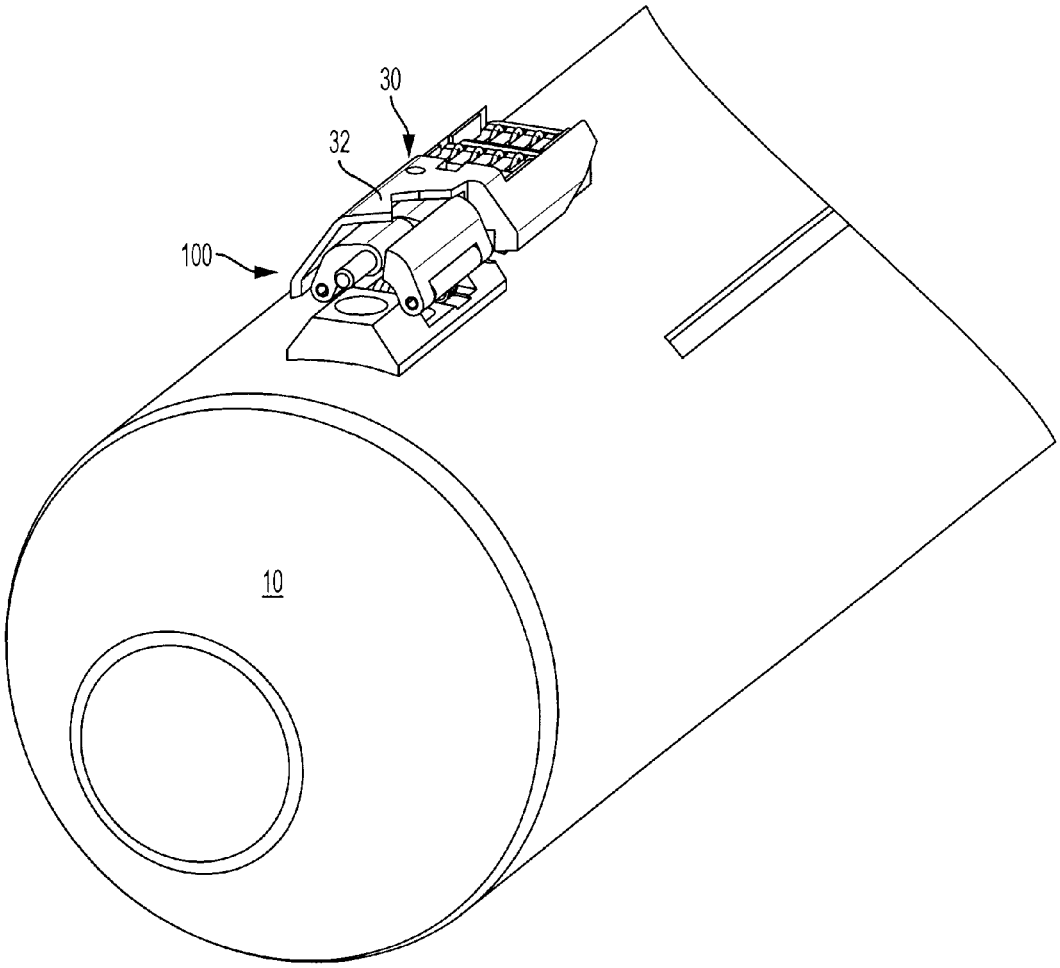
FIG. 1 is a perspective view of a float support member according to an exemplary embodiment of the invention, showing the float support member mounted to a rocket (shown in partial view) and received in a connector housing (shown in partial view)
Figure 2:
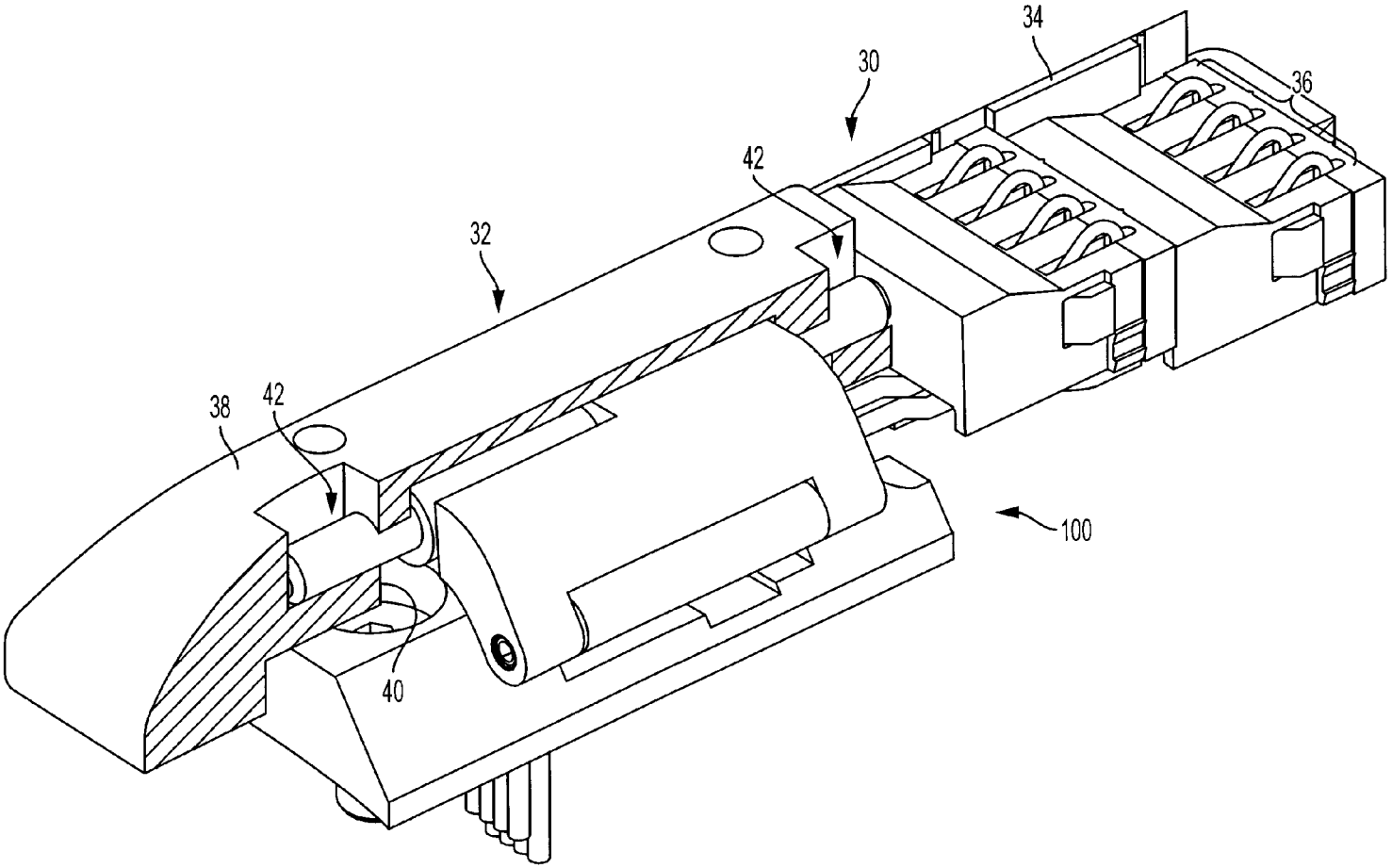
FIG. 2 is an enlarged perspective view of the float support member illustrated in FIG. 1, showing a portion of the connector housing in which the float support member is received, removed.

As seen in FIGS. 1 and 2, the float support member 100 is mounted to the rocket 10 and is coupled to a connector component 30 that is configured to electrically contact a mating connector component (not shown) of the launch tube housing 20. The float support member 100 is designed such that the connector component 30 remains electrically connected to its mating connector component on the launcher independent of the position of the rocket 10 within the launch tube housing 20. A frame 32 of the connector component 30 has a first part 34 that supports a plurality of contacts 36, that engage contacts of the mating connector component, and a second part 38 that supports the float support member 100. The second part 38 of the frame 32 includes an inner cavity 40 for receiving the float support member 100 and keyways 42 at either end of the inner cavity 40 for receiving a pin of the float support member 100, as best seen in FIG. 2.

Figure 3A:
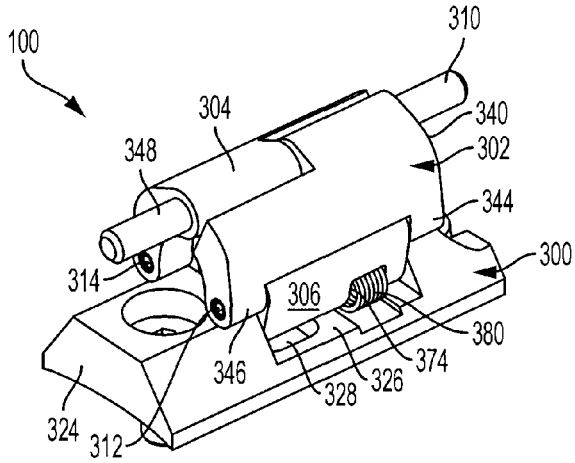
FIGS. 3*a*-3*d* are perspective, elevational, end, and plan views, respectively, of the float support member illustrated in FIG. 1.
Figure 3B:
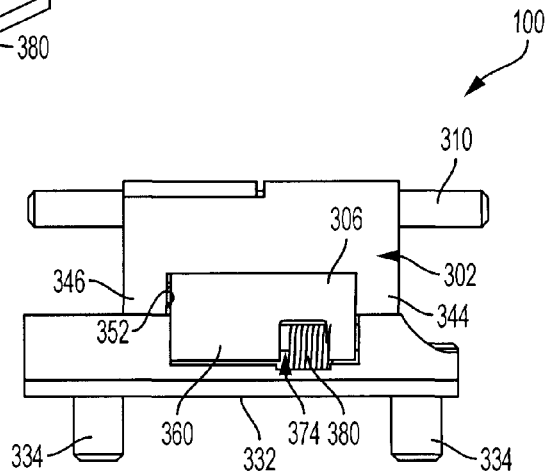
Figure 3C:
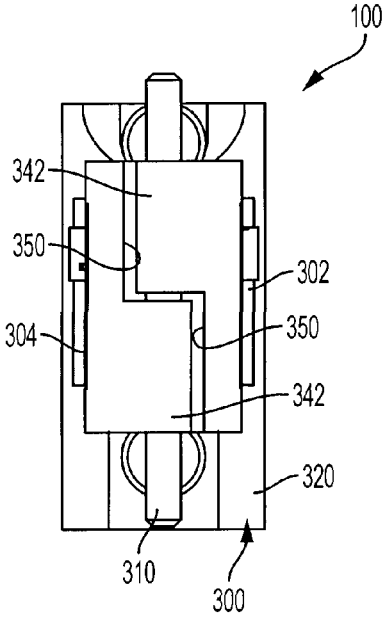
Figure 3D:
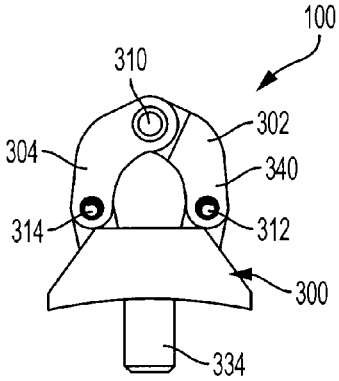

As seen in FIGS. 3*a*-3*d*, the float support member 100 generally includes a base 300, first and second primary linkages 302 and 304 that are hinged together by a primary pin 310, and first and second secondary linkages 306 and 308 that are hinged to the primary linkages 302 and 304 by secondary pins 312 and 314, respectively. The primary pin 310 is preferably longer and larger in diameter than the secondary pin 312 and 314. The base 300 has an elongate body 320 that includes first and second end portions 322 and 324 with an intermediate recessed portion 326 therebetween. The intermediate recessed portion 326 preferably has a length that accommodates the second linkages 306 and 308, as best seen in FIG. 3*b* (showing secondary linkage 306). Disposed in the intermediate recessed portion 326 is a wire opening 328 for receiving wiring that can extend through a wire routing path 330 (FIG. 4) defined between the linkages 302, 304, 306, and 308 and the base 300. The wiring extending through the wire routing path 330 can connect to the connector components of the rocket launcher. The base includes a rocket engaging surface 332 opposite the linkages and the base end portions 322 and 324 are adapted to accept fasteners 334, such as bolts, for mounting the float support member 100, and particularly its engaging surface 332, to the rocket 100.

The first and second primary linkages 302 and 304 are preferably substantially identical and may generally include a substantially curved body 340 with a primary hinge 342 at one side and two secondary hinges 344 and 346 at the opposite side of the body 340. The primary hinge 342 includes an inner bore 348 for receiving the primary pin 310. A recessed area 350 is formed adjacent to the primary hinge 342 to accommodate the primary hinge 342 of the other of the first and second first primary linkages 302 and 304. That is, the primary hinge 342 of the first primary linkage 302 is positioned in the recessed area 350 of the second primary linkage 304 and likewise the primary hinge 342 of the second primary linkage 304 is positioned in the recessed area 350 of the first primary linkage 302 such that the inner bores 348 of the primary hinges 342 of both linkages align to receive the primary pin 310. The opposing ends 316 preferably extend out of the bores 348 beyond the length of the primary linkages 302 and 304 for engagement with the keyways 42 of the connector component frame 32, as seen in FIG. 2. The two secondary hinges 344 and 346 have aligned inner bores that accept one of the secondary pins 312 and 314, respectively. Between the two secondary hinges 344 and 346 is a receiving area 352 that accepts a portion of one of the secondary linkages 306 and 308, as best seen in FIGS. 3*a* and 3*b* showing first secondary linkage 306.

Figure 4:
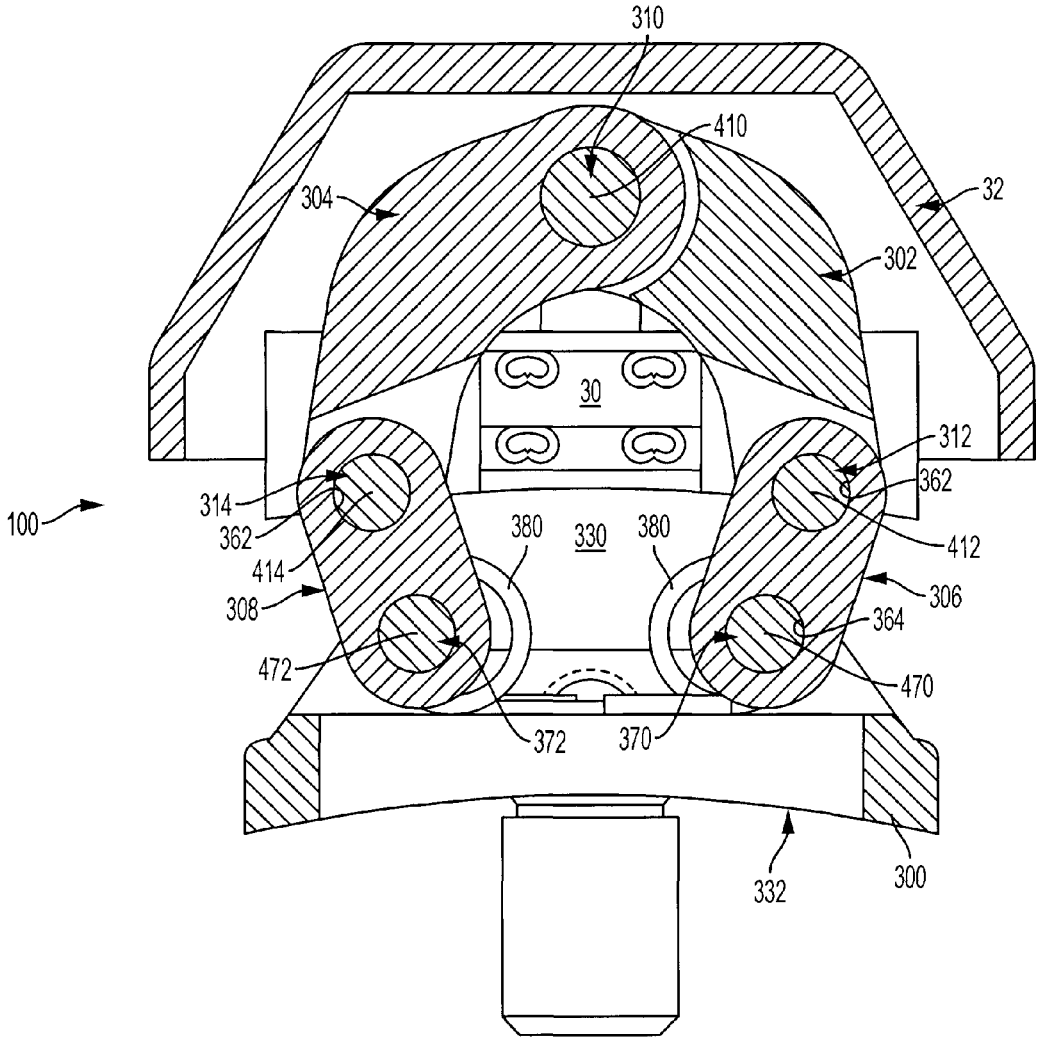
FIG. 4 is a cross-sectional view of the float support member illustrated in FIG. 1.

As seen in FIGS. 3*a*, 3*b* and 4, the secondary linkages 306 and 308 are preferably substantially identical and may generally include a body 360 with substantially flat surfaces and spaced first and second substantially parallel bores 362 and 364 extending through the body 360. A portion of the body 360 of each secondary linkage 306 and 308 is accommodated in the receiving area 352 of the first and second primary linkages 302 and 304, respectively, such that the second bore 364 of each secondary linkage 306 and 308 aligns with the bores of the secondary hinges 344 and 346 of the primary linkages 302 and 304 to receive the secondary pins 312 and 314, respectively.

Another portion of the body 360 of each secondary linkage 306 and 308 is accommodated in the recessed area 326 of the base 300 such that the second bores 364 of the secondary linkages 306 and 308 align with corresponding holes in the end portions 322 and 324 of the base 300 to accept first and second stationary pins 370 and 372 (FIG. 4), respectively. Each second bore 364 of the secondary linkages 306 and 308 is preferably discontinuous in that a gap 374 is formed, as best seen in FIGS. 3*a* and 3*b*. The gap 374 may receive a spring member 380, such as a torsion spring. Each stationary pin 370 and 372 extends through one of the spring members 380. Ends of the spring members 380 preferably engage the bodies 360 of the secondary linkages 306 and 308, such that the secondary linkages 306 and 308 are driven outwardly away from one another to the lowest profile of the float support member 100, as seen in FIG. 5*b*. By biasing the linkages 306 and 308 outwardly using spring members 380, the float support member 100 becomes flatter and forms a low profile which keeps the connector component 30 tight against the rocket 10 even when not loaded in the launch tube housing 20. This facilitates installation of the rocket 10 in the launch tube housing 20 and improves the aerodynamics of the rocket 10.

As seen in FIG. 4, the primary pin 310 of the float support member 100 defines a primary movable pin point 410, the first secondary pin 312 defines a first secondary movable pin point 412, and the second secondary pin 314 defines a second secondary movable pin point 414. The first and second stationary pins 370 and 372 define first and second stationary pin points 470 and 472, respectively. As the float support member 100 moves, the primary movable pin point 410 and the secondary movable pin points 412 and 414 may move in two directions: a lateral direction (e.g. X axis) and a transverse direction (e.g. Y axis) that is transverse to the lateral direction, thereby providing two degrees of freedom for the rocket. The position of the primary movable pin point 410 (e.g. along the X and Y axes) depends on the positions of the secondary movable pin points 412 and 414, and vice versa. The stationary pin points 470 and 472 do not move when the float support member 100 moves between positions.

FIGS. 5*a*, 6*a*, 7*a*, and 8*a*, illustrate four exemplary float positions, respectively, of the rocket 10 with respect to the launch tube housing 20 provided by the float support member 100 of the present invention. FIGS. 5*b*, 6*b*, 7*b*, and 8*b* illustrate the position of the float support member 100 corresponding to the rocket position of FIGS. 5*a*, 6*a*, 7*a* and 8*a*, respectively. It will be understood that the illustrate positions are exemplary and that the float support member 100 allows float anywhere along the lateral (X-axis) and transverse (Y-axis) directions.

Figure 5A:
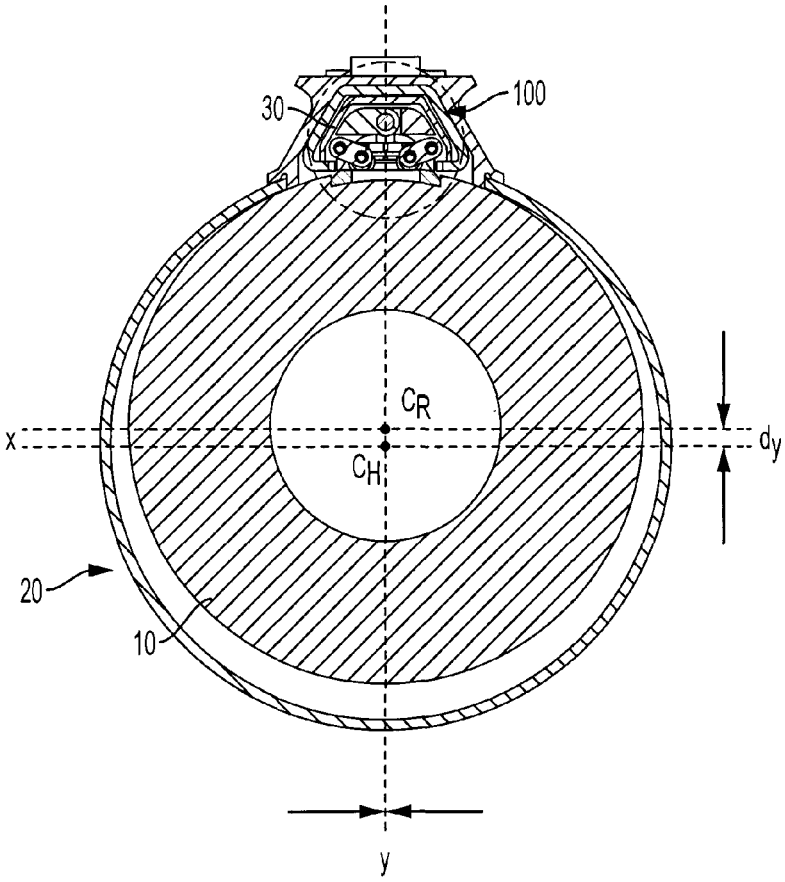
FIGS. 5*a* and 5*b* are cross-sectional views showing one relative position of the rocket with respect to a launch tube housing and the corresponding position of the float support member, respectively.
Figure 5B:
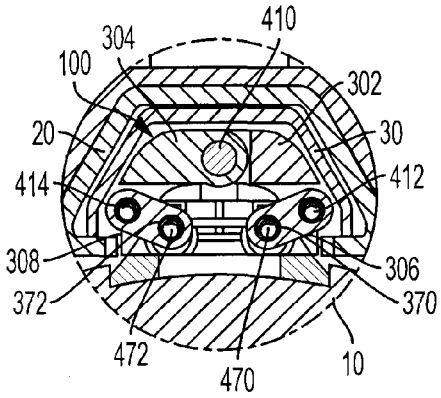

Referring to FIG. 5*a*, the rocket 10 may be positioned within the housing 20 such that it is radially offset closest to the connector component 30 mounted on the housing 20 (seen as the top of the housing in FIG. 5*a*, for example). In that position, a center point $C_R$ of the rocket 10 is offset from a center point of the housing $C_H$ by a distance $d_y$ in the Y axis or transverse direction while having no offset in the X axis or lateral direction. In a preferred embodiment, the distance $d_y$ of FIG. 5*a* may be approximately 0.09 inches, for example. FIG. 5*b* illustrates the position of the linkages and pin points of the float support member 100 corresponding to FIG. 5*a*. In that position, the float support member 100 is in a generally compressed or low profile position such that the secondary linkages 306 and 308 pivot outwardly with respect to the stationary pins 370 and 372 away from one another and the corresponding first and second secondary movable point pins 412 and 414 move outwardly away from another. The primary linkages 302 and 3*o*4 compress such that the associated primary movable pin point 410 moves toward the stationary pin points 470 and 472. The spring members 380 (FIG. 4) preferably bias the float support member 100, and particularly the secondary linkages 306 and 308 in the compressed position shown in FIG. 5*b*.

Figure 6A:
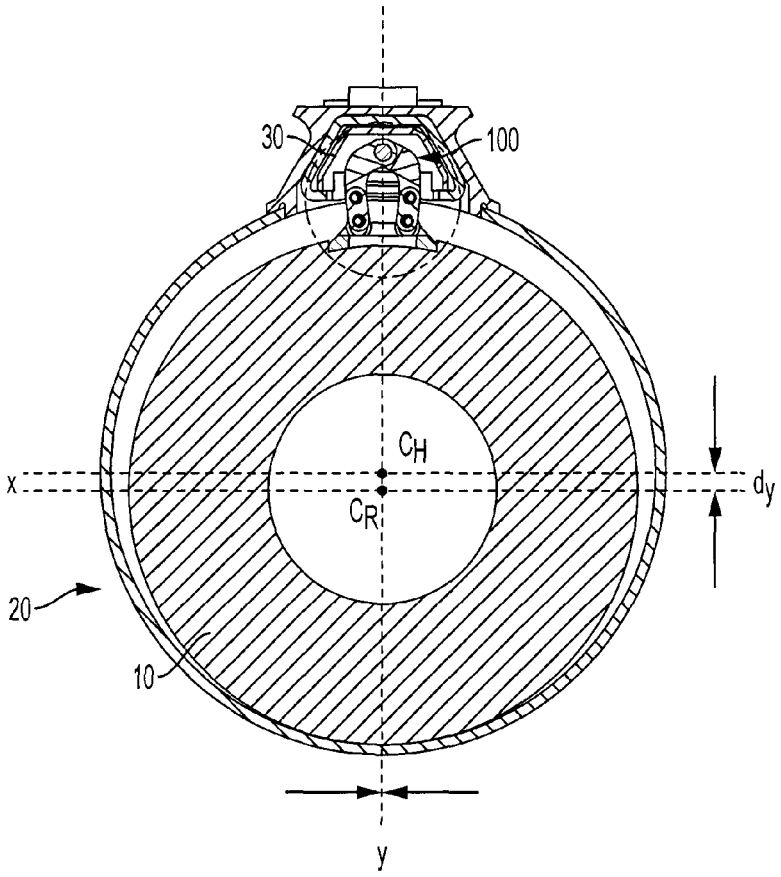
FIGS. 6*a* and 6*b* are cross-sectional views showing another relative position of the rocket with respect to a launch tube housing and the corresponding position of the float support member, respectively.
Figure 6B:
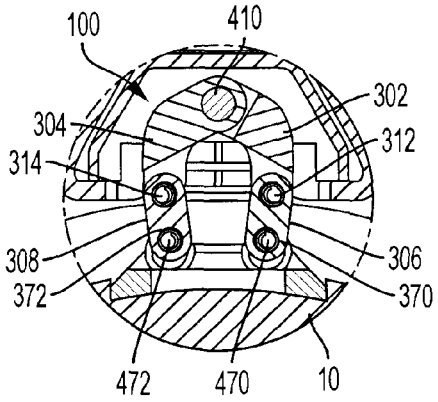

Referring to FIG. 6*a*, the rocket 10 may be positioned within the housing 20 such that it is radially offset furthest away from the connector component 30 mounted on the housing 20 (seen as the bottom of the housing in FIG. 6*a*, for example). In that position, a center point $C_R$ of the rocket 10 is offset from the center point $C_H$ of the housing by a distance $d_y$ in the Y axis direction while having no offset in the X axis direction. In a preferred embodiment, the distance $d_y$ of FIG. 6*a* may be approximately −0.09 inches, for example. FIG. 6*b* illustrates the position of the linkages and pin points of the float support member 100 corresponding to FIG. 6*a*. In that position, the float support member 100 is in a generally extended position such that the secondary linkages 306 and 308 are nearly parallel or slightly converge such that the first and second secondary movable pins 312 and 314 are nearly aligned with the first and second stationary pin 370 and 372, respectively. The primary linkages 302 and 304 extend toward the stationary pins 370 and 372 and the primary movable pin point 410 moves to a position remote from the stationary pin points 470 and 472. The float support member 100 may be moved to the extended position shown in FIG. 6*b* when there is sufficient force to over the spring members 380 that bias the float support member 100 in its compressed position shown in FIG. 5*b*. Such a force would be applied, for example, when the rocket is installed in the launch tube, during use of the launcher, or by motion of the launcher if attached to a vehicle or aircraft.

Figure 7A:
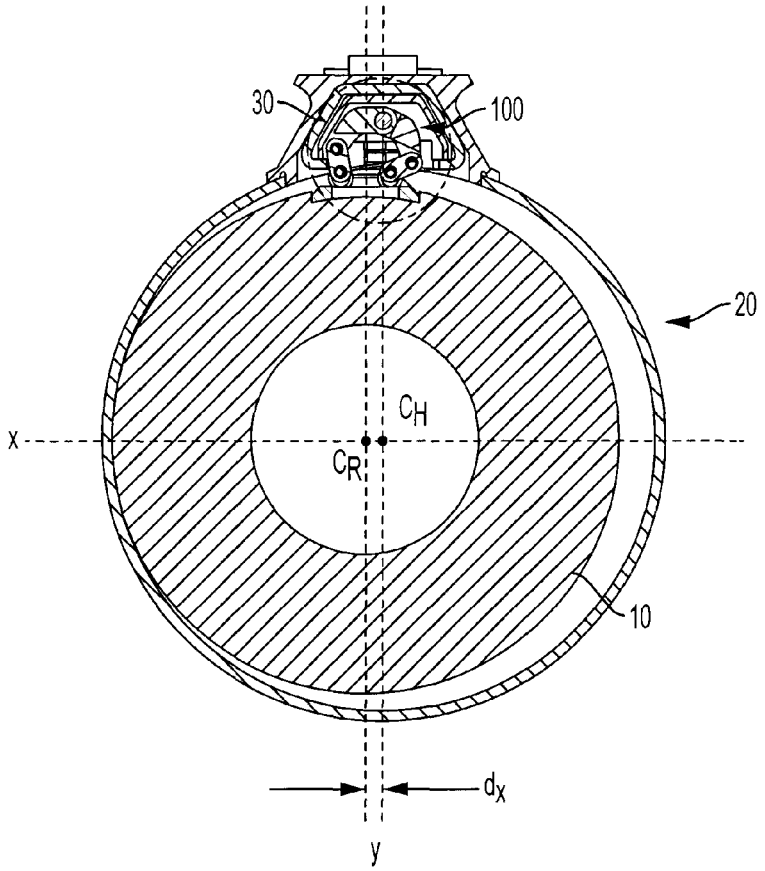
FIGS. 7*a* and 7*b* are cross-sectional views showing yet another relative position of the rocket with respect to a launch tube housing and the corresponding position of the float support member, respectively.
Figure 7B:
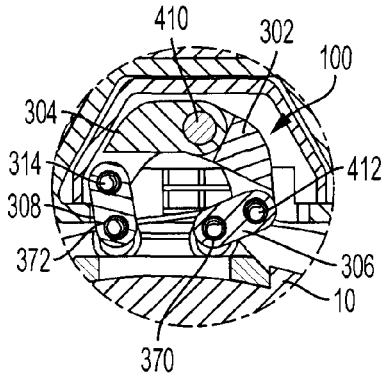

Referring to FIG. 7*a*, the rocket 10 may be positioned within the housing 20 such that it is radially offset towards a side the housing 20 (left side in FIG. 7*a*, for example). In that position, a center point $C_R$ of the rocket 10 is offset from the center point $C_H$ of the housing by a distance $d_x$ in the X axis direction while having no offset in the Y axis direction. In a preferred embodiment, the distance $d_x$ of FIG. 7*a* may be approximately −0.09 inches, for example. FIG. 7*b* illustrates the position of the linkages and pin points of the float support member 100 corresponding to FIG. 7*a*. In that position, the first secondary linkage 306 and its associated movable pin point 412 pivot outwardly with respect to first stationary pin 370 and away from second secondary linkage 308. The secondary movable pin 314 of the second secondary linkage 308 is nearly aligned with the second stationary pin 372. The first primary linkage 302 extends past the second primary linkage 304 toward the first stationary pin 370 such that the primary movable pin point 410 moves more toward the first secondary linkage 306 and away from the second secondary linkage 308. The float support member 100 may be moved to the position shown in FIG. 7*b* when there is sufficient force to over the spring members 380 in the same manner mentioned above.

Figure 8A:
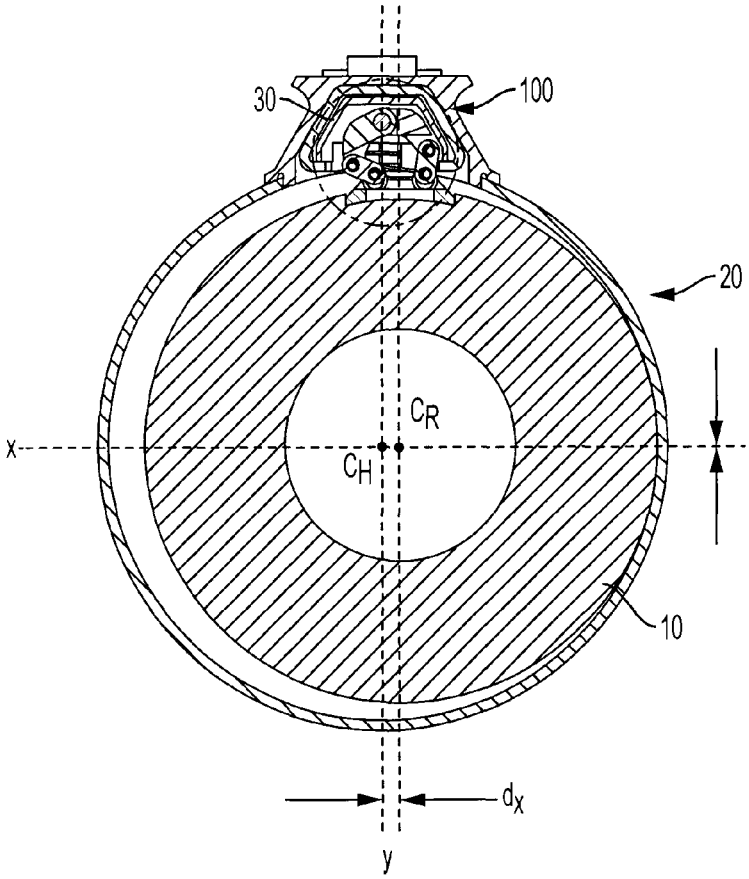
FIGS. 8*a* and 8*b* are cross-sectional views showing still another relative position of the rocket with respect to a launch tube housing and the corresponding position of the float support member.
Figure 8B:
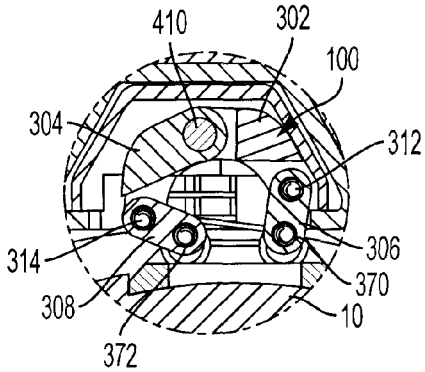

Referring to FIG. 8*a*, the rocket 10 may be positioned within the housing 20 such that it is radially offset towards a side the housing 20 opposite that of FIG. 7*a* (right side in FIG. 7*b*, for example). In that position, a center point $C_R$ of the rocket 10 is offset from the center point $C_H$ of the housing by a distance $d_x$ in the X axis direction while having no offset in the Y axis direction. In a preferred embodiment, the distance $d_x$ of FIG. 8*a* may be approximately 0.09 inches, for example. FIG. 8*b* illustrates the position of the linkages and pin points of the float support member 100 corresponding to FIG. 8*a*. In that position, the second secondary linkage 308 and its associated movable pin point 414 pivot outwardly with respect to second stationary pin 372 and away from first secondary linkage 306. The secondary movable pin 312 of the first secondary linkage 306 is nearly aligned with the first stationary pin 370. The second primary linkage 304 extends past the first primary linkage 302 toward the second stationary pin 372 such that the primary movable pin point 410 moves more toward the second secondary linkage 308 and away from the first secondary linkage 306. The float support member 100 may be moved to the position shown in FIG. 8*b* when there is sufficient force to over the spring members 380 in the same manner mentioned above.

While particular embodiments have been chosen to illustrate the invention, it will be understood by those skilled in the art that various changes and modifications can be made therein without departing from the scope of the invention as defined in the appended claims. For example, although the float support member of the present invention is shown as being used with the rocket and rocket launcher, the float support member of the present invention may be used with any object needing float within a housing. Additionally, the spring members 380 may be applied to any pivot pin or point to bias the float support member 100 to its compressed low profile position, as seen in FIG. 5*b*. Also, more than two spring members may be added to the float support member 100 to bias the same in the low profile position. Although only four positions of the rocket are illustrated, it will be understood that the design of the float support member 100 allows float in not just the positions illustrated in FIGS. 5*a*, 6*a*, 7*a*, and 8*a*, but all positions therebetween, that is ($d_x$, $d_y$).

What is claimed is:

1. A float support member, comprising:

a base for mounting to an object;

first and second primary linkages rotatably coupled by a primary pin, said primary pin defining a primary movable pin point that moves both in a lateral direction and a transverse direction transverse to said lateral direction;

first and second secondary linkages rotatably coupled to said first and second primary linkages, respectively, by first and second secondary pins, respectively, said first and second secondary pins defining first and second secondary movable pin points, respectively, that each move both in a lateral direction and a transverse direction transverse to said lateral direction, said first and second secondary linkages being rotatably coupled to said base by first and second stationary pins, respectively, defining first and second stationary pin points, respectively, wherein the position of said primary movable pin point in both the lateral and transverse directions depends on the position of both of said first and second secondary moveable pin points in both the lateral and transverse directions and vice versa.

2. A float support member according to claim 1, wherein each of said first and second secondary linkages includes a spring member, said spring members biasing said first and second secondary movable pin points, respectively, outwardly away from one another.

3. A float support member according to claim 2, wherein said spring members are torsion springs through which said first and second secondary pins, respectively, extend.

4. A float support member according to claim 1, wherein said first and second primary linkages are substantially identical; and said first and second secondary linkages are substantially identical.

5. A float support member according to claim 1, wherein each of said first and second primary linkages includes a primary hinge portion having an inner bore for receiving said primary pin and secondary hinge portions opposite said primary hinge portion, each of said secondary hinge portions having an inner bore for receiving one of said first and second secondary pins.

6. A float support member according to claim 5, wherein each of said first and second primary linkages are substantially curved.

7. A float support member according to claim 5, wherein each of said first and second primary linkages includes a recessed area adjacent said primary hinge portion, said recessed area of one of said first and second primary linkages is adapted to receive said primary hinge of the other of said first and second primary linkages.

8. A float support member according to claim 5, wherein each of said first and second secondary linkages includes a first bore that aligns with said inner bores of said secondary hinge portions of said first and second primary linkages, respectively, for receiving said first and second secondary pins, respectively.

9. A float support member according to claim 8, wherein each of said first and second secondary linkages includes a second bore spaced from and substantially parallel to said first bore for receiving said first and second stationary pins, respectively.

10. A float support member, comprising:

a base configured for mounting to an object receivable in a housing;

first and second primary linkages rotatably coupled by a primary pin, said primary pin being supported by said housing, and said primary pin defining a primary movable pin point that moves both in a lateral direction and a transverse direction transverse to said lateral direction;

first and second secondary linkages rotatably coupled to said first and second primary linkages, respectively, by first and second secondary pins, respectively, said first and second secondary pins defining first and second secondary movable pin points, respectively, that each move both in a lateral direction and a transverse direction transverse to said lateral direction, said first and second secondary linkages being rotatably coupled to said base by first and second stationary pins, respectively, defining first and second stationary pin points, respectively, wherein the position of said primary movable pin point in both the lateral and transverse directions depends on the position of both of said first and second secondary moveable pin points in both the lateral and transverse directions and vice versa, thereby providing two degrees of freedom between the base and the housing.

11. A float support member according to claim 10, wherein each of said first and second secondary linkages includes a spring member, said spring members biasing said first and second secondary movable pin points, respectively, outwardly away from one another.

12. A float support member according to claim 11, wherein said spring members are torsion springs disposed on said first and second secondary pins, respectively.

13. A float support member according to claim 10, wherein said first and second primary linkages are substantially identical; and said first and second secondary linkages are substantially identical.

14. A float support member according to claim 10, wherein each of said first and second primary linkages includes a primary hinge portion having an inner bore for receiving said primary pin and secondary hinge portions opposite said primary hinge portion, each of said secondary hinge portions having an inner bore for receiving one of said first and second secondary pins.

15. A float support member according to claim 14, wherein each of said first and second primary linkages includes a recessed area adjacent said primary hinge portion, said recessed area of one of said first and second primary linkages is adapted to receive said primary hinge of the other of said first and second primary linkages.

16. A float support member according to claim 15, wherein each of said first and second secondary linkages includes a first bore that aligns with said inner bores of said secondary hinge portions of said first and second primary linkages, respectively, for receiving said first and second secondary pins, respectively.

17. A float support member according to claim 16, wherein each of said first and second secondary linkages includes a second bore spaced from and substantially parallel to said first bore for receiving said first and second stationary pins, respectively.

18. A float support member according to claim 17, wherein each of said second bores being discontinuous, thereby forming a gap that receives a spring member, said first and second stationary pins extending through said spring members of each of said second bores, respectively, each of said spring members having ends that engage said first and second secondary linkages, respectively, for biasing said first and second secondary linkages outwardly.

19. A float support member according to claim 10, wherein said primary pin is larger than said first and second secondary pins in both length and diameter; and opposing ends of said primary pin extend beyond a length of said first and second primary linkages.

20. A float support member for a rocket launcher, comprising:

a base mounted to a rocket received in a launch tube housing;

first and second primary linkages rotatably coupled by a primary pin, said primary pin being coupled to a frame supported by said launch tube housing, and said primary pin defining a primary movable pin point that moves both in a lateral direction and a transverse direction transverse to said lateral direction;

first and second secondary linkages rotatably coupled to said first and second primary linkages, respectively, by first and second secondary pins, respectively, said first and second secondary pins defining first and second secondary movable pin points, respectively, that each move both in a lateral direction and a transverse direction transverse to said lateral direction, said first and second secondary linkages being rotatably coupled to said base by first and second stationary pins, respectively, defining first and second stationary pin points, respectively, each of said first and second secondary linkages including a spring member, said spring members biasing said first and second secondary movable pin points, respectively, outwardly away from one another, said first and second stationary pins extending through each of said spring members, respectively, wherein the position of the rocket with respect to the launch tube housing is determined by the position of said primary movable pin point in both the lateral and transverse directions which depends on the position of both of said first and second secondary moveable pin points in both the lateral and transverse directions and vice versa, thereby providing two degrees of freedom between the rocket and the launch tube housing.

21. A float support member according to claim 20, wherein said frame is part of a connector component that mates with a corresponding connector component on said launch tube housing.

22. A float support member according to claim 20, wherein said first and second primary linkages are substantially identical; and said first and second secondary linkages are substantially identical.

23. A float support member according to claim 20, wherein each of said first and second primary linkages includes a primary hinge portion having an inner bore for receiving said primary pin and secondary hinge portions opposite said primary hinge portion, each of said secondary hinge portions having an inner bore for receiving one of said first and second secondary pins; and each of said first and second primary linkages includes a recessed area adjacent said primary hinge portion, said recessed area of one of said first and second primary linkages is adapted to receive said primary hinge of the other of said first and second primary linkages.

24. A float support member according to claim 23, wherein each of said first and second secondary linkages includes a first bore that aligns with said inner bores of said secondary hinge portions of said first and second primary linkages, respectively, for receiving said first and second secondary pins, respectively; and each of said first and second secondary linkages includes a second bore spaced from and substantially parallel to said first bore for receiving said first and second stationary pins, respectively.

25. A float support member according to claim 20, wherein each of said second bores is discontinuous, thereby forming a gap that receives one of said spring members, each of said spring members is a torsion spring having ends that engage said first and second secondary linkages, respectively, for biasing said first and second secondary linkages outwardly.

26. A float support member according to claim 20, wherein said primary pin is larger than said first and second secondary pins in both length and diameter; and opposing ends of said primary pin extend beyond a length of said first and second primary linkages to engage said frame.

* * * * *